US010108113B2

(12) United States Patent
Kubota et al.

(10) Patent No.: US 10,108,113 B2
(45) Date of Patent: Oct. 23, 2018

(54) IMAGE FORMING APPARATUS WITH SWITCHING UNIT TO SWITCH LENGTH OF AT LEAST ONE OF A ROLLER PAIR

(71) Applicant: Konica Minolta, Inc., Chiyoda-ku, Tokyo (JP)

(72) Inventors: Aiko Kubota, Hino (JP); Takaaki Kooriya, Hachioji (JP); Toru Yamaguchi, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/446,130

(22) Filed: Mar. 1, 2017

(65) Prior Publication Data

US 2017/0255133 A1 Sep. 7, 2017

(30) Foreign Application Priority Data

Mar. 4, 2016 (JP) ..... 2016-041753

(51) Int. Cl.
*G03G 15/00* (2006.01)
*G03G 15/16* (2006.01)

(52) U.S. Cl.
CPC ..... *G03G 15/1605* (2013.01)

(58) Field of Classification Search
CPC ..... G03G 15/1605; G03G 15/167; G03G 15/1665; G03G 2215/00734
USPC ..... 399/313, 318, 45, 66
See application file for complete search history.

(56) References Cited

U.S. PATENT DOCUMENTS

2004/0043176 A1* 3/2004 Ogino ..... G03G 7/0013 428/40.1
2013/0051828 A1* 2/2013 Yogosawa ..... G03G 15/5058 399/66
2016/0227061 A1* 8/2016 Hasegawa ..... H04N 1/00734
2016/0320741 A1* 11/2016 Ohmura ..... G03G 21/0047

FOREIGN PATENT DOCUMENTS

JP 2005300615 A 10/2005
JP 2016212365 A * 12/2016

OTHER PUBLICATIONS

Omura et al., "Image Forming Apparatus", Dec. 2016, JP2016212365A, Detailed Description, English Machine Translation by JPO.*

* cited by examiner

*Primary Examiner* — Susan Lee
(74) *Attorney, Agent, or Firm* — Cantor Colburn LLP

(57) ABSTRACT

An image forming apparatus includes: a primary transfer unit configured to transfer a toner image formed on an image carrier onto an intermediate transfer belt through primary transfer; and a secondary transfer unit configured to transfer the toner image formed on the intermediate transfer belt onto a recording medium through secondary transfer, wherein the secondary transfer unit extends along a width direction of the recording medium and includes a roller pair and a switching unit, the roller pair being configured to nip the intermediate transfer belt and the recording medium such that the intermediate transfer belt and the recording medium are in pressure contact with each other, the switching unit being configured to switch a length of at least one of the roller pair in a shaft direction.

6 Claims, 7 Drawing Sheets

FIG. 6

SETTING TABLE T

| FIRST SECONDARY TRANSFER ROLLER | SECOND SECONDARY TRANSFER ROLLER | THIRD SECONDARY TRANSFER ROLLER | FOURTH SECONDARY TRANSFER ROLLER | FIFTH SECONDARY TRANSFER ROLLER |
|---|---|---|---|---|
| 45pt | 40pt | 35pt | 30pt | 25pt |

IMAGE FORMING APPARATUS WITH SWITCHING UNIT TO SWITCH LENGTH OF AT LEAST ONE OF A ROLLER PAIR

The entire disclosure of Japanese Patent Application No. 2016-041753 filed on Mar. 4, 2016 including description, claims, drawings, and abstract are incorporated herein by reference in its entirety.

BACKGROUND OF THE INVENTION

Field of the Invention

The present invention relates to an image forming apparatus.

Description of the Related Art

In related art, an image forming apparatus that includes an image forming unit and a transfer unit and employs an electrophotographic system is known. The image forming unit forms a toner image on an image carrier, and the transfer unit transfers the toner image on the image carrier onto an intermediate transfer belt through primary transfer and transfers the intermediate toner image on the intermediate transfer belt onto a recording medium through secondary transfer (for example, see JP 2005-300615 A).

In a mechanism that performs the secondary transfer, the intermediate transfer belt and the recording medium are nipped so as to be in pressure contact with each other by a backup roller and a secondary transfer roller. The intermediate transfer belt is stretched over the backup roller, and the secondary transfer roller opposes the backup roller with the intermediate transfer belt interposed therebetween.

Normally, in such an image forming apparatus, the widths of the backup roller and the secondary transfer roller are fixed to widths larger than the maximum width of a recording medium that can be subjected to image formation.

Therefore, for example, in the case of using a recording medium of a small size, an area of rollers that comes into contact with the recording medium is small. In this case, although necessary control such as temperature control is only required to be performed on this area, an unnecessary area of the rollers is also controlled at the same time. This leads to a low productivity.

Moreover, for example, in the case of using a label paper sheet as the recording medium, glue is pushed out of an end portion of the label paper sheet by being nipped by the rollers and is attached to components that come into contact with the recording medium in the course of image formation. This causes malfunctions such as image defect and failure in sheet conveyance, and the glue requires to be cleaned. This leads to a low productivity.

SUMMARY OF THE INVENTION

The present invention has been made in consideration of the technical problems described above, and an object of the present invention is to provide an image forming apparatus that is capable of improving the productivity by switching a secondary transfer roller to a secondary transfer roller of a size suitable for the recording medium.

To achieve the abovementioned object, according to an aspect, an image forming apparatus reflecting one aspect of the present invention comprises: a primary transfer unit configured to transfer a toner image formed on an image carrier onto an intermediate transfer belt through primary transfer; and a secondary transfer unit configured to transfer the toner image formed on the intermediate transfer belt onto a recording medium through secondary transfer, wherein the secondary transfer unit extends along a width direction of the recording medium and includes a roller pair and a switching unit, the roller pair being configured to nip the intermediate transfer belt and the recording medium such that the intermediate transfer belt and the recording medium are in pressure contact with each other, the switching unit being configured to switch a length of at least one of the roller pair in a shaft direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 illustrates an exemplary setting table;

DESCRIPTION OF THE PREFERRED EMBODIMENTS

Hereinafter, an embodiment of the present invention will be described with reference to the drawings. However, the scope of the invention is not limited to the illustrated examples.

First, a configuration of an image forming apparatus according to the embodiment will be described.

Figure 1:
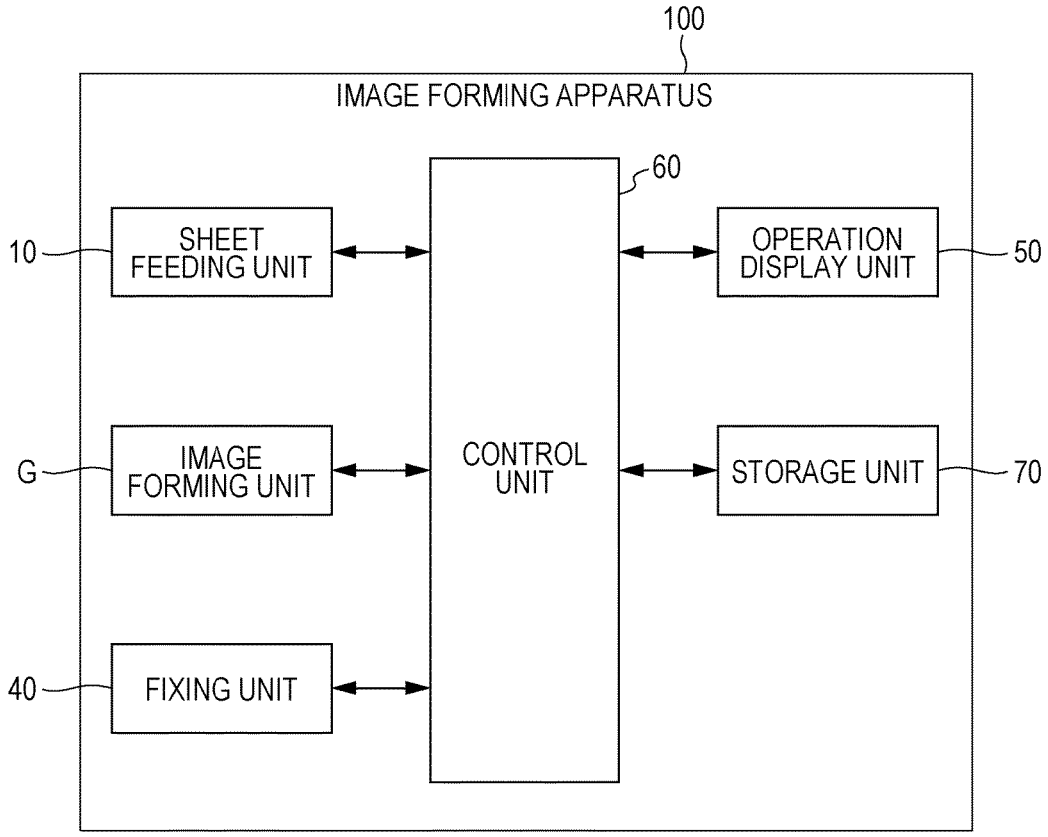
FIG. 1 is a functional block diagram illustrating a configuration of an image forming apparatus according to an embodiment.
Figure 2:
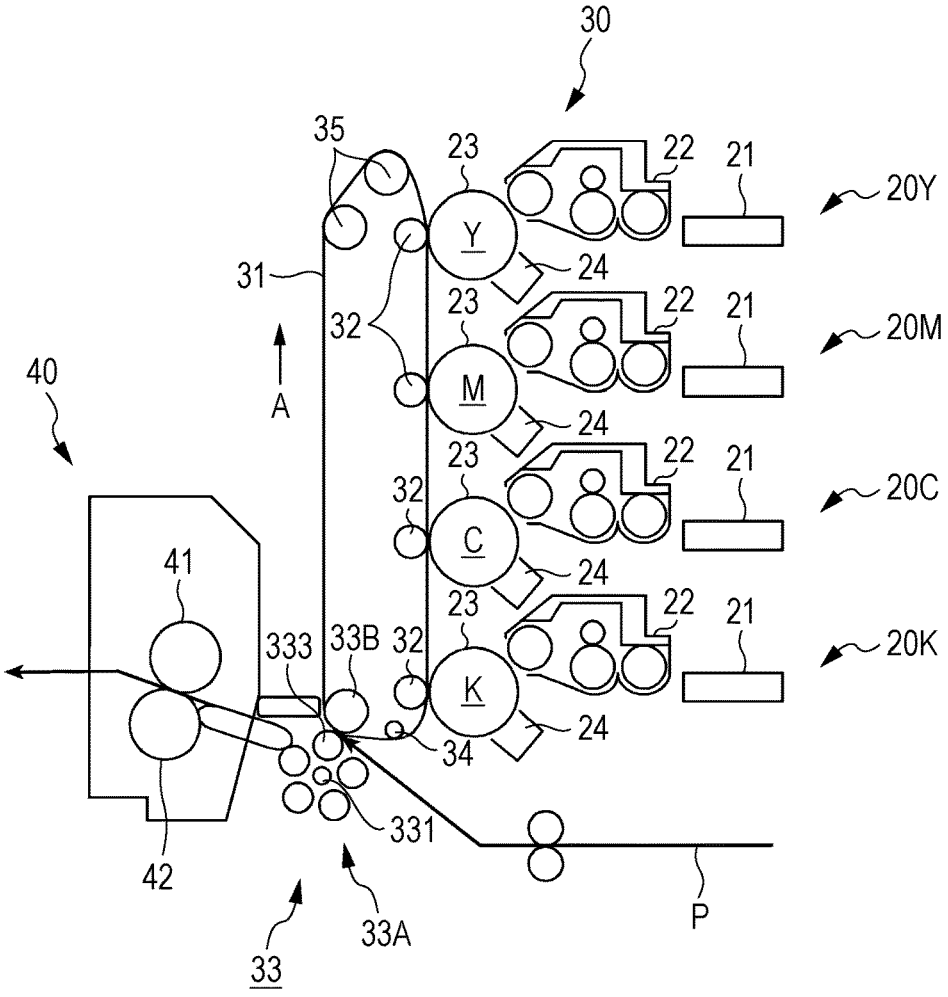
FIG. 2 is a schematic diagram illustrating a partial configuration of the image forming apparatus illustrated in FIG. 1.

FIG. 1 is a functional block diagram illustrating a control configuration of an image forming apparatus 100. FIG. 2 is a schematic diagram illustrating a partial configuration of the image forming apparatus 100.

As illustrated in FIG. 1 and FIG. 2, the image forming apparatus 100 includes, for example, a sheet feeding unit 10, an image forming unit G, a fixing unit 40, an operation display unit 50, a control unit 60, and a storage unit 70.

The sheet feeding unit 10 includes a plurality of trays (not illustrated), and each tray stores a recording medium P of a different size. In the embodiment, the recording medium P is, for example, a label paper sheet formed by two sheets laminated with a sticking layer interposed therebetween. The recording medium P stored in each tray is conveyed to a secondary transfer unit 33 that will be described later through a predetermined conveyance path.

The image forming unit G includes, for example, image forming units 20Y, 20M, 20C, and 20K, a transfer unit 30, and the like. The image forming units 20Y, 20M, 20C, and 20K respectively form images with color toners of yellow (Y), magenta (M), cyan (C), and black (K) on the basis of an image formation job (hereinafter simply referred to as a "job") transmitted from an external apparatus.

The image forming units 20Y, 20M, 20C, and 20K respectively corresponding to a Y component, an M component, a C component, and a K component are the same in configuration. For convenience of illustration and description, same constituents are denoted by the same reference letters.

The configuration of an image forming unit will be described by taking the image forming unit 20Y as an example.

The image forming unit 20Y includes an exposure unit 21, a developing unit 22, a photoconductor (image carrier) 23, a charging unit 24, and the like.

The charging unit 24 uniformly charges the surface of the photoconductor 23 that is photoconductive to a negative polarity. The exposure unit 21 is constituted by, for example, a semiconductor laser, and irradiates the photoconductor 23 with laser light corresponding to an image of a corresponding color component. On the surface of the photoconductor 23, an electrostatic latent image of a corresponding color component is formed due to a potential difference between the irradiated area of the photoconductor 23 and the surrounding area thereof. The developing unit 22 accommodates developer of a corresponding color component, and forms a toner image by attaching toner of a corresponding color component to the surface of the photoconductor 23 to visualize the electrostatic latent image.

The transfer unit 30 includes an intermediate transfer belt 31, primary transfer rollers (primary transfer units) 32, a secondary transfer unit 33, a driving roller 34, driven rollers 35, and a belt cleaning unit that is not illustrated.

The intermediate transfer belt 31 is configured as an endless belt, and is looped over a backup roller 33B of the secondary transfer unit 33, the driving roller 34, and the driven rollers 35. The intermediate transfer belt 31 moves in an arrow A direction at a constant speed due to the rotation of the backup roller 33B and the driving roller 34.

In the case where the intermediate transfer belt 31 is pressed against the photoconductors 23 by the primary transfer rollers 32, toner images of respective colors are sequentially transferred onto the intermediate transfer belt 31 through primary transfer such that the toner images are superposed on one another. Then, in the case where the intermediate transfer belt 31 is pressed against the recording medium P by a secondary transfer roller 333 of the secondary transfer unit 33, the intermediate toner image transferred onto the intermediate transfer belt 31 through primary transfer is transferred onto the recording medium P through secondary transfer.

Figure 3:
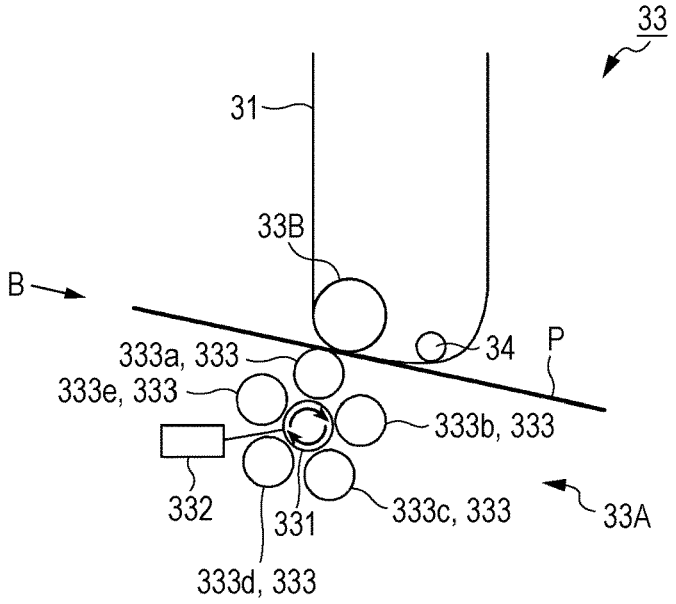
FIG. 3 is an enlarged view of a secondary transfer unit.

FIG. 3 is an enlarged view of the secondary transfer unit 33.

As illustrated in FIG. 3, the secondary transfer unit 33 includes, for example, a rotatable member 33A and the backup roller 33B. The rotatable member 33A includes a supporting portion 331, a driving unit 332 that rotates the supporting portion 331, a plurality of secondary transfer rollers 333 rotatably supported by the supporting portion 331, and so forth. The rotatable member 33A functions as a switching unit together with the control unit 60.

The supporting portion 331 is a long bar-shaped member, and is positioned at the center of the plurality of secondary transfer rollers 333 to rotatably support the plurality of secondary transfer rollers 333. The supporting portion 331 is rotated by a driving force of the driving unit 332, and the secondary transfer roller 333 opposing the backup roller 33B among the plurality of secondary transfer rollers 333 is thereby switched.

The driving unit 332 is, for example, a driving mechanism including a gear, a driving motor, and so forth, and rotates the supporting portion 331 about a shaft parallel to shafts of the secondary transfer rollers 333 in accordance with control by the control unit 60.

The plurality of secondary transfer rollers 333 is configured to be different from each other in the length thereof.

For example, in an exemplary configuration illustrated in FIG. 3, the plurality of secondary transfer rollers 333 includes five rollers of a first secondary transfer roller 333*a* of a length of 280 mm, a second secondary transfer roller 333*b* of a length of 240 mm, a third secondary transfer roller 333*c* of a length of 200 mm, a fourth secondary transfer roller 333*d* of a length of 170 mm, and a fifth secondary transfer roller 333*e* of a length of 130 mm.

These secondary transfer rollers 333 are each a driven roller rotatably supported by the supporting portion 331. One of the plurality of secondary transfer rollers 333 is selected in accordance with the size of the recording medium P, and the selected secondary transfer roller 333 is rotated along with the backup roller 33B.

The length of the secondary transfer roller 333 selected from the plurality of secondary transfer rollers 333 in the shaft direction is smaller than the width of the recording medium P in a direction perpendicular to the conveyance direction. In addition, among secondary transfer rollers 333 that are shorter than the width of the recording medium P in the direction perpendicular to the conveyance direction, the longest secondary transfer roller 333 is preferably selected as a secondary transfer roller of the most suitable length.

Figure 4:
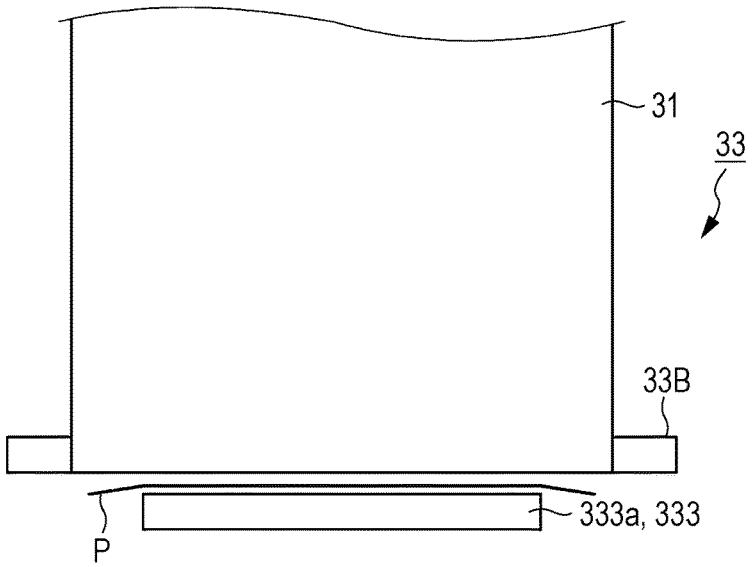
FIG. 4 illustrates a part illustrated in FIG. 3 viewed from an arrow B direction.

FIG. 4 illustrates the secondary transfer unit 33 viewed from an arrow B direction illustrated in FIG. 3. To be noted, only the selected secondary transfer roller 333 is illustrated in FIG. 4.

As illustrated in FIG. 4, by using the secondary transfer roller 333 shorter than the width of the recording medium P, it becomes possible to prevent glue from being pushed out of an edge portion of the recording medium P because the edge portion of the recording medium P in the width direction is not pressed when the recording medium P passes through a nip portion of the backup roller 33B and the secondary transfer roller 333. Accordingly, glue is prevented from attaching to components of the transfer unit 30, in particular, to the intermediate transfer belt 31, the secondary transfer roller 333, the backup roller 33B, and the like.

The backup roller 33B is a driving roller over which the intermediate transfer belt 31 is stretched. The secondary transfer roller 333 disposed in a position opposing the backup roller 33B is driven along with the backup roller 33B.

Referring back to FIGS. 1 and 2, the fixing unit 40 fixes the toner image transferred onto the recording medium P.

For example, the fixing unit 40 includes a heating roller 41 and a pressurizing roller 42 for nipping the recording medium P.

The heating roller 41 is heated to a predetermined temperature by a heater that is a heat source.

The pressurizing roller 42 is urged toward the heating roller 41 by an elastic member that is not illustrated. The recording medium P onto which the toner image has been transferred is subjected to heat and pressure by passing through a nip portion of the heating roller 41 and the pressurizing roller 42, and the toner image is thereby melted and fixed.

The operation display unit 50 includes a display screen, a display portion that displays various information on the screen, and an operation portion that is used by a user to input various instructions.

The control unit 60 is constituted by, for example, a central processing unit (CPU) and a random access memory (RAM). The CPU of the control unit 60 reads various programs stored on the storage unit 70 such as a system program and a processing program, loads the programs into the RAM, and performs various processing such as secondary-transfer-roller switching processing and image formation processing in accordance with the loaded programs.

The storage unit 70 is constituted by, for example, a hard disk drive (HDD), a semiconductor nonvolatile memory, or the like.

The storage unit 70 stores various programs including a system program and a processing program to be executed by the control unit 60 and data necessary for executing these programs. For example, the storage unit 70 stores setting information necessary for performing image formation processing.

Next, an operation of the image forming apparatus 100 according to the embodiment will be described.

Figure 5:
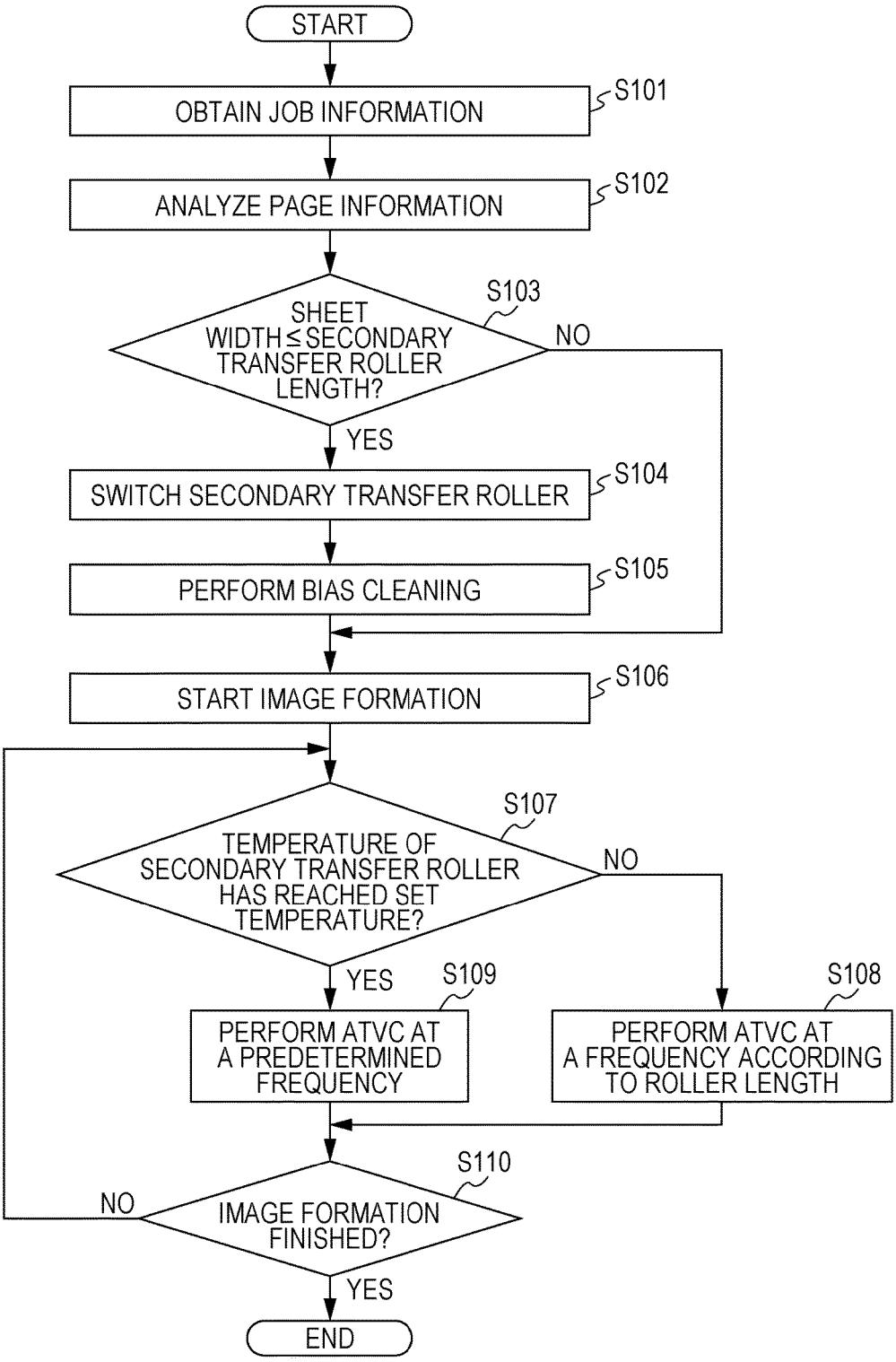
FIG. 5 is a flowchart illustrating an operation of an image forming apparatus.

FIG. 5 is a flowchart illustrating a series of operations including secondary-transfer-roller switching processing and image formation processing performed in the image forming apparatus 100.

First, a user inputs an instruction to start a job (START), and the control unit 60 obtains job information (step S101).

Next, the control unit 60 analyzes page information included in the obtained job information, and obtains the width of a recording medium P on which an image is to be formed (step S102).

Next, the control unit 60 determines whether or not the length of a secondary transfer roller 333 that is currently set (that is opposing the backup roller 33B) is equal to or larger than the obtained width of the recording medium P (step S103).

Then, in the case where the length of the set secondary transfer roller 333 is smaller than the width of the recording medium P obtained in step S102 described above (step S103: NO), the control unit 60 proceeds to step S106 that will be described later.

In contrast, in the case where the length of the set secondary transfer roller 333 is equal to or larger than the width of the recording medium P obtained in step S102 described above (step S103: YES), the control unit 60 switches the secondary transfer roller 333 (step S104).

More specifically, the control unit 60 selects, in accordance with the size (width) of the recording medium P obtained in step S102 described above, a secondary transfer roller 333 of the most suitable length, and drives the driving unit 332 to rotate the supporting portion 331 such that the selected secondary transfer roller 333 is moved to a position opposing the backup roller 33B.

For example, in the case where the size of the recording medium P is A3 or A4, the first secondary transfer roller 333*a* is selected. In the case where the size of the recording medium P is B4 or B5, the second secondary transfer roller 333*b* is selected. In the case where the size of the recording medium P is A6, the third secondary transfer roller 333*c* is selected. In the case where the size of the recording medium P is B6, the fourth secondary transfer roller 333*d* is selected. In the case where the size of the recording medium P is B7, the fifth secondary transfer roller 333*e* is selected.

According to the embodiment, in the case where the length of the set secondary transfer roller 333 is equal to or larger than the width of the recording medium P in step S103, the secondary transfer roller 333 is switched in step S104.

Therefore, in the case where the set secondary transfer roller 333 is shorter than the width of the recording medium P, the secondary transfer roller 333 is not switched even if the set secondary transfer roller 333 does not have the length most suitable for the width of the recording medium P. This control minimizes the number of switching of the secondary transfer roller 333, and thus suppresses lowering of productivity.

The switching of the secondary transfer roller 333 in step S104 may be performed in the case where it is determined in step S103 that the length of the set secondary transfer roller 333 is not the most suitable for the width of the recording medium P.

In the case where such control is performed, the stability of conveyance of the recording medium P can be improved because the secondary transfer roller 333 of the most suitable length for the width of the recording medium P can be set.

Next, the control unit 60 performs bias cleaning of applying a high voltage to cancel potential differences between rollers of the transfer unit 30 (step S105).

Next, the control unit 60 starts image formation on the recording medium P (step S106).

Next, the control unit 60 determines whether or not the temperature of the secondary transfer roller 333 has reached a set temperature (step S107).

In the case where the temperature of the secondary transfer roller 333 has not reached the set temperature (step S107: NO), the control unit 60 serving as a voltage control unit performs voltage control (automatic transfer voltage control: ATVC) at a frequency corresponding to the length of the secondary transfer roller 333 (step S108).

Here, the voltage control (ATVC) is control of measuring the electric resistance of the intermediate transfer belt 31, which constantly changes during image formation as a result of the temperature of the intermediate transfer belt 31 rising due to the conveyance of the recording medium P, and adjusting the voltage, that is, control of determining the value of the most suitable voltage corresponding to the value of the electric resistance of the intermediate transfer belt 31.

It has been found out that the shorter the secondary transfer roller 333 is, the steeper the change of temperature of the intermediate transfer belt 31 is. Thus, the storage unit 70 stores in advance, for example, a setting table T illustrated in FIG. 6 in which the correspondence between the length of the secondary transfer roller 333 and the frequency of the voltage control is stored.

The control unit 60 performs the voltage control at a frequency corresponding to the length of the secondary transfer roller 333 by using the setting table T.

In the setting table T illustrated in FIG. 6, it is set that the voltage control is performed at a higher frequency when the secondary transfer roller 333 is shorter. For example, in the case where the first secondary transfer roller 333*a* of 280 mm is used, the voltage control is performed for every 45 pages, and, in the case where the fifth secondary transfer roller 333*e* of 130 mm is used, the voltage control is performed for every 25 pages.

In contrast, in the case where the secondary transfer roller 333 has reached the set temperature (step S107: YES), the control unit 60 serving as the voltage control unit performs the voltage control at a predetermined frequency (for example, for every 50 pages) (step S109).

Subsequently, the control unit 60 determines whether or not image formation of final image data has been performed, that is, whether or not the image formation has been finished (step S110). In the case where the image formation has not been finished (step S110: NO), the processing returns to step S107 described above and subsequent steps are performed again.

Meanwhile, in the case where the image formation has been finished (step S110: YES), the control unit 60 ends the processing.

As has been described above, according to the embodiment, the image forming apparatus 100 includes the primary transfer rollers 32 that each transfer a toner image formed on the photoconductor 23 onto the intermediate transfer belt 31 through primary transfer and the secondary transfer unit 33 that transfers the toner image formed on the intermediate transfer belt 31 onto the recording medium P through secondary transfer. The secondary transfer unit 33 includes a roller pair (the secondary transfer roller 333 and the backup roller 33B) that extends in the width direction of the recording medium P and nips the intermediate transfer belt 31 and the recording medium P such that the intermediate transfer belt 31 and the recording medium P are in pressure contact with each other, and the length of the secondary transfer roller 333 in the shaft direction is switchable.

In addition, according to the embodiment, the recording medium P is a label paper sheet, and the length of the secondary transfer roller 333 in the shaft direction is switched to a length shorter than the width of the recording medium P, which is the length of the recording medium P in the width direction perpendicular to the conveyance direction of the recording medium P.

Therefore, glue does not attach to the components of the secondary transfer unit 33, in particular, to the secondary transfer roller 333 and the intermediate transfer belt 31, and thus the damage to the components of the secondary transfer unit 33 is reduced and failure in image transfer is suppressed.

In addition, downtime resulting from cleaning caused by the attachment of glue is suppressed, and the productivity can be improved.

Moreover, the embodiment includes the rotatable member 33A and the control unit 60. The rotatable member 33A includes the plurality of secondary transfer rollers 333 and the supporting portion 331. The plurality of secondary transfer rollers 333 have different lengths from each other in the shaft direction, and the supporting portion 331 rotatably supports the plurality of secondary transfer rollers 333 and is rotatable about a shaft parallel to the shaft direction. The control unit 60 selects one roller from the plurality of secondary transfer rollers 333 in accordance with the width of the recording medium P, and rotates the supporting portion 331 to cause the one roller to oppose the intermediate transfer belt 31.

Therefore, the secondary transfer roller 333 of the most suitable length can be selected from the plurality of secondary transfer rollers 333 of different lengths.

Further, the embodiment includes the backup roller 33B that is a driving roller over which the intermediate transfer belt 31 is stretched, and the secondary transfer roller 333 is a driven roller that is driven along with the backup roller 33B.

By configuring the secondary transfer roller 333 as a driven roller, the damage to the secondary transfer roller 333 and the intermediate transfer belt 31 caused in switching of the secondary transfer roller 333 can be suppressed. In addition to this, retraction operation of the secondary transfer roller 333 is not needed in the switching of the secondary transfer roller 333, and thus lowering of the productivity can be suppressed.

Retraction operation of the secondary transfer roller 333 is not needed when replacing the secondary transfer roller 333, either, for the reason of deterioration or the like, and thus lowering of the productivity can be suppressed.

Further, according to the embodiment, the control unit 60 performs the voltage control for determining the value of voltage corresponding to the value of electric resistance of the secondary transfer roller 333 at a predetermined frequency in image formation, and, in the case where the secondary transfer roller 333 is switched, changes the frequency at which the voltage control is performed until the temperature of the secondary transfer roller 333 after switching reaches a set temperature in accordance with the length of the secondary transfer roller 333 after switching in the shaft direction.

Thus, the stability of transfer after switching the secondary transfer roller 333 is improved.

Modification Embodiment

Next, a modification embodiment of the embodiment will be described.

In the modification embodiment, in the case of successively performing a plurality of jobs in which image formation is performed on recording media P having different widths, the jobs are sorted for image formation.

Figure 7:
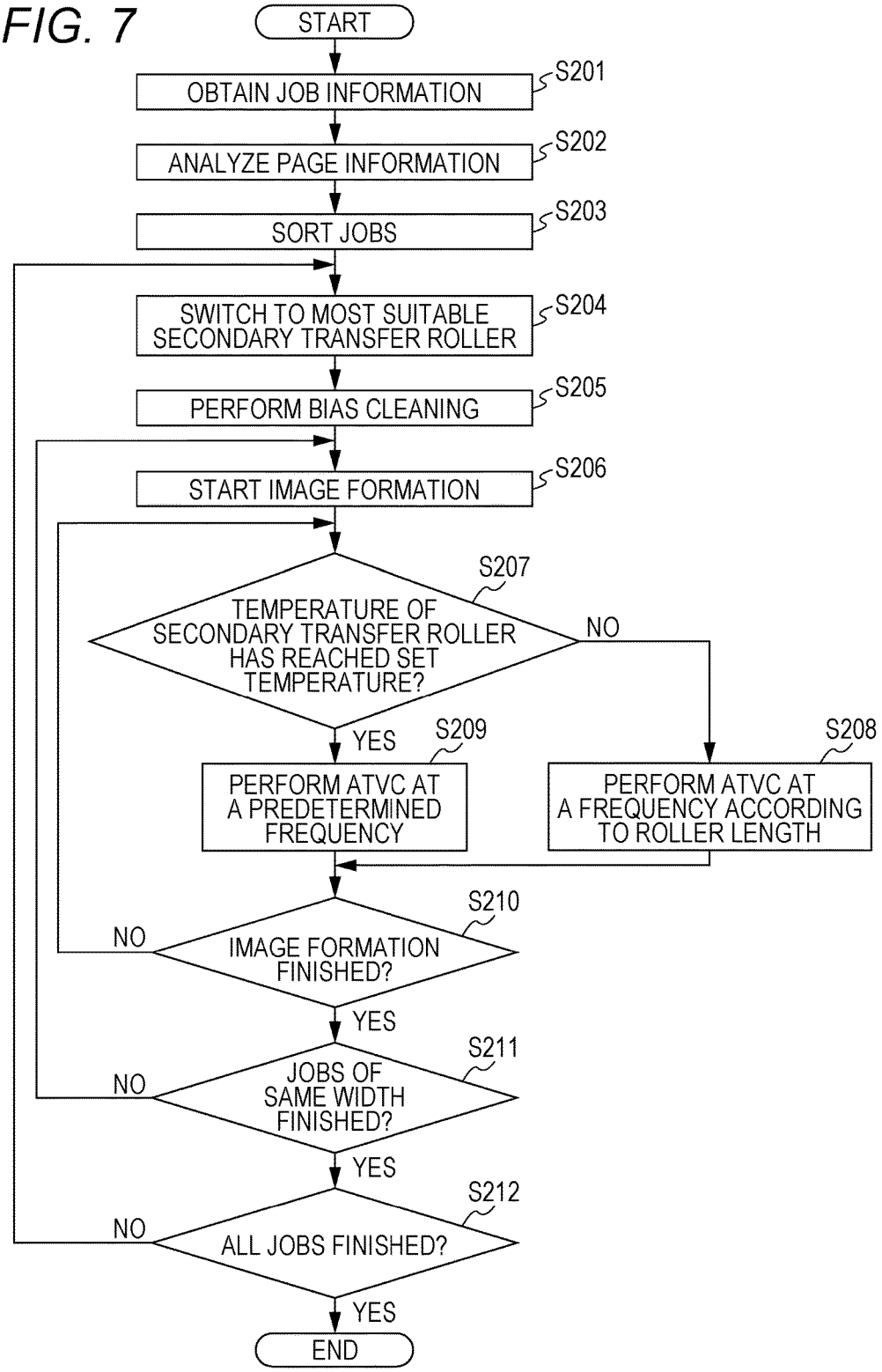
FIG. 7 is a flowchart illustrating an operation according to an modification embodiment of the image forming apparatus.

FIG. 7 is a flowchart illustrating a series of operations including secondary-transfer-roller switching processing and image formation processing performed in the case of sorting the jobs.

First, the control unit 60 performs, as steps S201 and S202, the processing of steps S101 and S102 illustrated in FIG. 5.

Next, the control unit 60 serving as a sorting control unit sorts the jobs on the basis of the page information analyzed in step S202 (step S203).

For example, it is assumed that a job 1 using a recording medium P of A4 size, a job 2 using a recording medium P of B5 size, and a job 3 using a recording medium P of A4 size are on standby in this order.

In this case, the control unit 60 changes the order of jobs to be performed from the job 1, the job 2, and then the job 3 to the job 1, the job 3, and then the job 2.

Subsequently, the control unit 60 switches the secondary transfer roller 333 to the secondary transfer roller 333 of the most suitable length for the width of the recording medium P designated in the job 1 (step S204).

In the case where the secondary transfer roller 333 of the most suitable length is already set at this time, the set secondary transfer roller 333 is used as it is.

Next, the control unit 60 performs, in steps S205 to S210, the same processing of steps S105 to S110 illustrated in FIG. 5.

Subsequently, the control unit 60 determines whether or not jobs corresponding to the recording media P of the same width have been finished (step S211). In the case where the jobs have not been finished (step S211: NO), the processing returns to step S206 described above and subsequent steps are performed again.

In contrast, in the case where the jobs corresponding to the recording media P of the same width have been finished (step S211: YES), the control unit 60 determines whether or not all jobs have been finished (step S212). In the case where the jobs have not been finished (step S212: NO), the processing returns to step S204 described above and subsequent steps are performed again.

Meanwhile, in the case where the jobs have been finished (step S212: YES), the control unit 60 ends the processing.

As described above, according to the modification embodiment, in the case where image formation is to be successively performed on recording media P of different widths, the control unit 60 changes the order of image formation such that image formation on the recording media P of the same width is successively performed.

Thus, in the case where the plurality of jobs of performing image formation on recording media P of different widths is successively performed, the number of switching of the secondary transfer roller 333 can be minimized, the downtime caused by bias cleaning is suppressed, and thus the productivity can be improved.

Embodiments of the present invention have been described above. The details of the configuration are not limited to the embodiments described above, and can be modified within the scope of the present invention.

For example, although the secondary transfer roller 333 is configured as a driven roller in the embodiment described above, the secondary transfer roller 333 may be a driving roller (second driving roller) that drives together with the backup roller 33B.

In this case, a driving mechanism is provided for each of the secondary transfer rollers 333, and, in image formation, only the driving mechanism of the selected secondary transfer roller 333 drives to drive only the selected secondary transfer roller 333.

Figure 8:
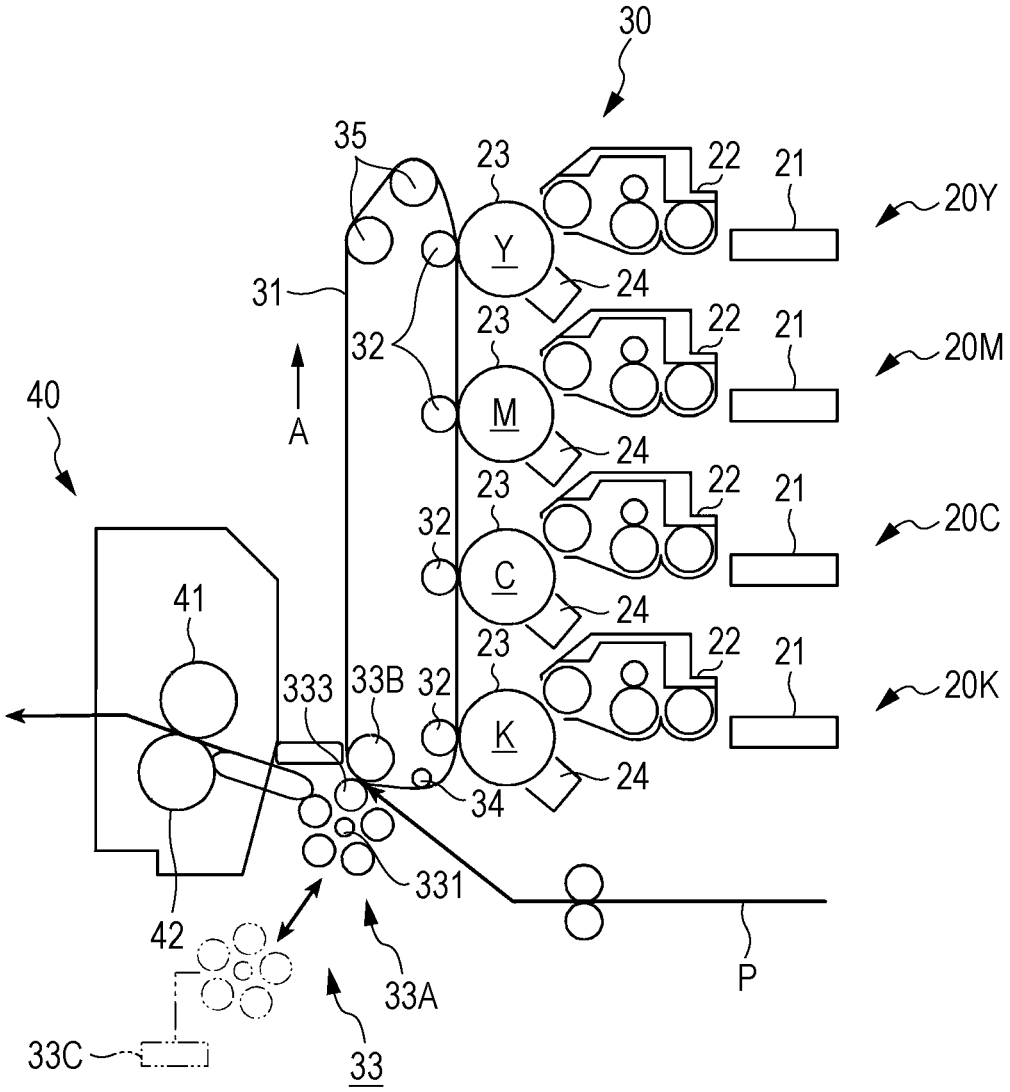
FIG. 8 illustrates a configuration of secondary transfer rollers provided with a retracting mechanism.

In this case, the secondary transfer unit 33 includes a retracting mechanism 33C that separates the rotatable member 33A from the intermediate transfer belt 31 by a predetermined distance, and, when switching the secondary transfer roller 333 or replacing the secondary transfer roller 333 due to deterioration or the like, the retracting mechanism 33C moves the rotatable member 33A away from the intermediate transfer belt 31 as illustrated in FIG. 8.

According to such a configuration, the damage to the secondary transfer roller 333 and the intermediate transfer belt 31 caused when switching or replacing the secondary transfer roller 333 can be suppressed.

Further, although the number of the secondary transfer rollers 333 provided for the secondary transfer unit 33 is five in the embodiment described above, the number of the secondary transfer rollers 333 is not limited to this.

In the embodiment described above, a configuration in which the secondary transfer unit 33 includes the plurality of secondary transfer rollers 333 and the secondary transfer rollers 333 are used selectively is described as an example. However, a configuration in which a single secondary transfer roller 333 capable of expanding and contracting in the shaft direction and the secondary transfer roller 333 expands or contracts in accordance with the width of the recording medium P to switch the length thereof may be also employed. In addition, a configuration in which the secondary transfer roller 333 is constituted by a plurality of separable members and is divided in accordance with the width of the recording medium P to switch the length thereof may be employed.

Further, although a configuration in which the length of the secondary transfer roller 333 in the secondary transfer unit 33 is switched has been described as an example in the embodiment described above, a configuration in which the length of the backup roller 33B is switched instead of the secondary transfer roller 333 may be employed.

A configuration in which both of the lengths of the secondary transfer roller 333 and the backup roller 33B are switched in the secondary transfer unit 33 may be also employed.

In addition, although a case where the recording medium P is a label paper sheet has been described as an example in the embodiment described above, the recording medium P is not limited to this and may be any kinds of sheet.

For example, according to an exemplary configuration in which the length of the secondary transfer roller 333 (and/or the backup roller 33B) is switched so as to be slightly greater than the width of the recording medium P in accordance with the recording medium P in the case where the recording medium. P is a normal paper sheet, temperature control or the like of an excessive portion of the roller does not require to be performed, and lowering of the productivity can be suppressed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a primary transfer unit configured to transfer a toner image formed on an image carrier onto an intermediate transfer belt through primary transfer;

a secondary transfer unit configured to transfer the toner image formed on the intermediate transfer belt onto a recording medium through secondary transfer;

a sorting control unit that, in a case where image formation is successively performed on recording media having different widths, changes an order of image formation such that image formation is successively performed on recording media having the same width;

wherein the secondary transfer unit includes a roller pair and a switching unit, the roller pair being configured to nip the intermediate transfer belt and the recording medium such that the intermediate transfer belt and the recording medium are in pressure contact with each other, the switching unit being configured to switch a length of at least one of the roller pair in a shaft direction.

2. The image forming apparatus according to claim 1, wherein the switching unit includes:

a rotatable member including a plurality of rollers having different lengths in the shaft direction from each other and a supporting portion that rotatably supports the plurality of rollers and is rotatable about a shaft parallel to the shaft direction; and a control unit that selects one roller from the plurality of rollers in accordance with a width of the recording medium and rotates the supporting portion to cause the one roller to oppose the intermediate transfer belt, and the one roller is one of the roller pair.

3. The image forming apparatus according to claim 2, wherein the roller pair includes a driving roller over which the intermediate transfer belt is stretched and a driven roller that is driven along with the driving roller, and the one roller is the driven roller.

4. The image forming apparatus according to claim 2, wherein the roller pair includes a first driving roller over which the intermediate transfer belt is stretched and a second driving roller that drives together with the first driving roller, the one roller is the second driving roller, and the secondary transfer unit includes a retracting mechanism that moves the rotatable member away from the intermediate transfer belt.

5. An image forming apparatus as claimed in claim 1 configured to form images on a label paper sheet as the recording medium, and the label paper sheet is formed by sheets laminated with a sticking layer interposed therebetween.

6. An image forming apparatus comprising:

a primary transfer unit configured to transfer a toner image formed on an image carrier onto an intermediate transfer belt through primary transfer;

a secondary transfer unit configured to transfer the toner image formed on the intermediate transfer belt onto a recording medium through secondary transfer, the secondary transfer unit comprising a roller pair and a switching unit, the roller pair being configured to nip the intermediate transfer belt and the recording medium such that the intermediate transfer belt and the recording medium are in pressure contact with each other, the switching unit being configured to switch a length of at least one of the roller pair in a shaft direction;

a voltage control unit that performs voltage control of determining a value of voltage corresponding to a value of an electric resistance of the roller pair at a predetermined frequency, and, in a case where the length of the at least one of the roller pair has been switched, changes the frequency of performing the voltage control in accordance with the length of the at least one of the roller pair after switching until a temperature of the at least one of the roller pair after switching reaches a set temperature.

* * * * *